US008387547B2

(12) United States Patent
Bardh et al.

(10) Patent No.: US 8,387,547 B2
(45) Date of Patent: Mar. 5, 2013

(54) TOP FEEDER FOR A SEWING MACHINE

(75) Inventors: Jonas Bardh, Jonkoping (SE); Eskil Hakansson, Jonkoping (SE)

(73) Assignee: VSM Group, Huskvarna (SE)

( * ) Notice: Subject to any disclaimer, the term of this patent is extended or adjusted under 35 U.S.C. 154(b) by 0 days.

(21) Appl. No.: 13/377,564

(22) PCT Filed: Jun. 11, 2009

(86) PCT No.: PCT/SE2009/050722

§ 371 (c)(1),
(2), (4) Date: Dec. 11, 2011

(87) PCT Pub. No.: WO2010/144013

PCT Pub. Date: Dec. 16, 2010

(65) Prior Publication Data

US 2012/0085274 A1 Apr. 12, 2012

(51) Int. Cl.
*D05B 27/06* (2006.01)

(52) U.S. Cl. ..... 112/313

(58) Field of Classification Search ..... 112/470.03, 112/470.04, 313, 312
See application file for complete search history.

(56) References Cited

U.S. PATENT DOCUMENTS

| | | | | | |
|---|---|---|---|---|---|
| 3,570,426 | A | * | 3/1971 | Kunes | 112/320 |
| 4,116,145 | A | * | 9/1978 | Nicolay | 112/320 |
| 4,214,540 | A | * | 7/1980 | Cook | 112/235 |
| 4,412,498 | A | * | 11/1983 | Scholl | 112/313 |
| 4,503,794 | A | * | 3/1985 | Ishihara et al. | 112/313 |
| 4,686,917 | A | * | 8/1987 | Braun | 112/311 |
| 4,726,309 | A | * | 2/1988 | Popp | 112/313 |
| 4,867,082 | A | * | 9/1989 | Sabbioni et al. | 112/470.04 |
| 5,138,962 | A | * | 8/1992 | Klundt | 112/311 |

* cited by examiner

*Primary Examiner* — Danny Worrell
(74) *Attorney, Agent, or Firm* — Lando & Anastasi, LLP

(57) ABSTRACT

A top feeder arrangement for a sewing machine provided with a processor for controlling stitches sewn on a cloth, wherein the sewing machine has a sewing machine head which comprises a needle mechanism with a needle bar (1) provided with a needle (2), a presser bar (3) provided with a presser foot (4) and a top feeder arm (10) provided at its lower end with a top feeder (11) acting from an upper surface of a cloth for feeding the cloth in the sewing direction and wherein the sewing machine is provided with a mechanism (12, 15, 17, 18) providing a controllable pressure of the top feeder (11) against the cloth.

10 Claims, 4 Drawing Sheets

TOP FEEDER FOR A SEWING MACHINE

TECHNICAL FIELD

The present invention relates in general to sewing machines and in particular to a top feeder acting from the upper side of a piece of cloth being sewn for feeding said piece of cloth.

BACKGROUND OF THE INVENTION

Top feeders are known in prior art, for example through document U.S. Pat. No. 4,611,548. In said document it is described a top feeder providing a kinematically lifting drive for a top transport device, herein called a top feeder, as already indicated above, wherein the top feeder and a presser bar of the sewing machine are interconnected to each other. By this, according to the statements of the description, a space-saving arrangement of a top feeder rocker is achieved, of a seating for the top feeder and of the top feeder lifting drive. Through this arrangement it is achieved that a spring pressure acting on the top feeder extends essentially in the region of the axis of the presser bar such that lateral forces thereby are avoided.

In the top feeder of the described solution and related top feeders of prior art there are accordingly a kinematic connection between the presser bar and the top feeder for enabling a control of the movements of the top feeder, such as the movements being synchronized with cyclic movements performed by members of the sewing machines for performing stitches. A solution of this kind has limitations of the function of the top feeder. For example, when the top feeder is not in use and being swung away, it can be in the way and disturb the work for a user of the sewing machine. Further, different sewing results can come out in dependence of, for example, different thicknesses of pieces of cloth being sewn as well as in dependence of different materials of cloth being sewn.

SUMMARY OF THE INVENTION

The present invention is related to sewing machines and in particular to a top feeder acting from the upper side of a piece of cloth being sewn for feeding said piece of cloth and wherein a top feeder pressure against the piece of cloth can be adjusted manually or kept at a predetermined value.

According to one aspect of the invention a method with the characteristics of the appended claim 1 is presented.

According to a further aspect of the invention a sewing machine with the characteristics of the enclosed independent device claim is presented.

Further aspects and embodiments of the invention are presented in the dependent claims.

One of the advantages with the arrangement according to the invention is that it will be possible to set a desired pressure of the top feeder against the cloth or the multiple layers of cloth. Many different types of cloth exist differing from each other with respect to density, thickness, friction, etc., whereby a controlled pressure exerted by the top feeder as a result will improve the feed of the cloth during sewing. As an example, if two low friction pieces of cloth are sewn together, a high pressure is desirable to prevent shearing of the pieces of cloth, whereas during sewing on very thin pieces of cloth a lower pressure will be favourable in order to avoid marks on the pieces of cloth.

A further advantage is that it will be possible to determine the pressure the top feeder will exert on the cloth irrespective of variations of the thickness of the cloth or the thickness of multiple cloth layers to be sewn together.

DESCRIPTION OF EMBODIMENTS

Figure 1:
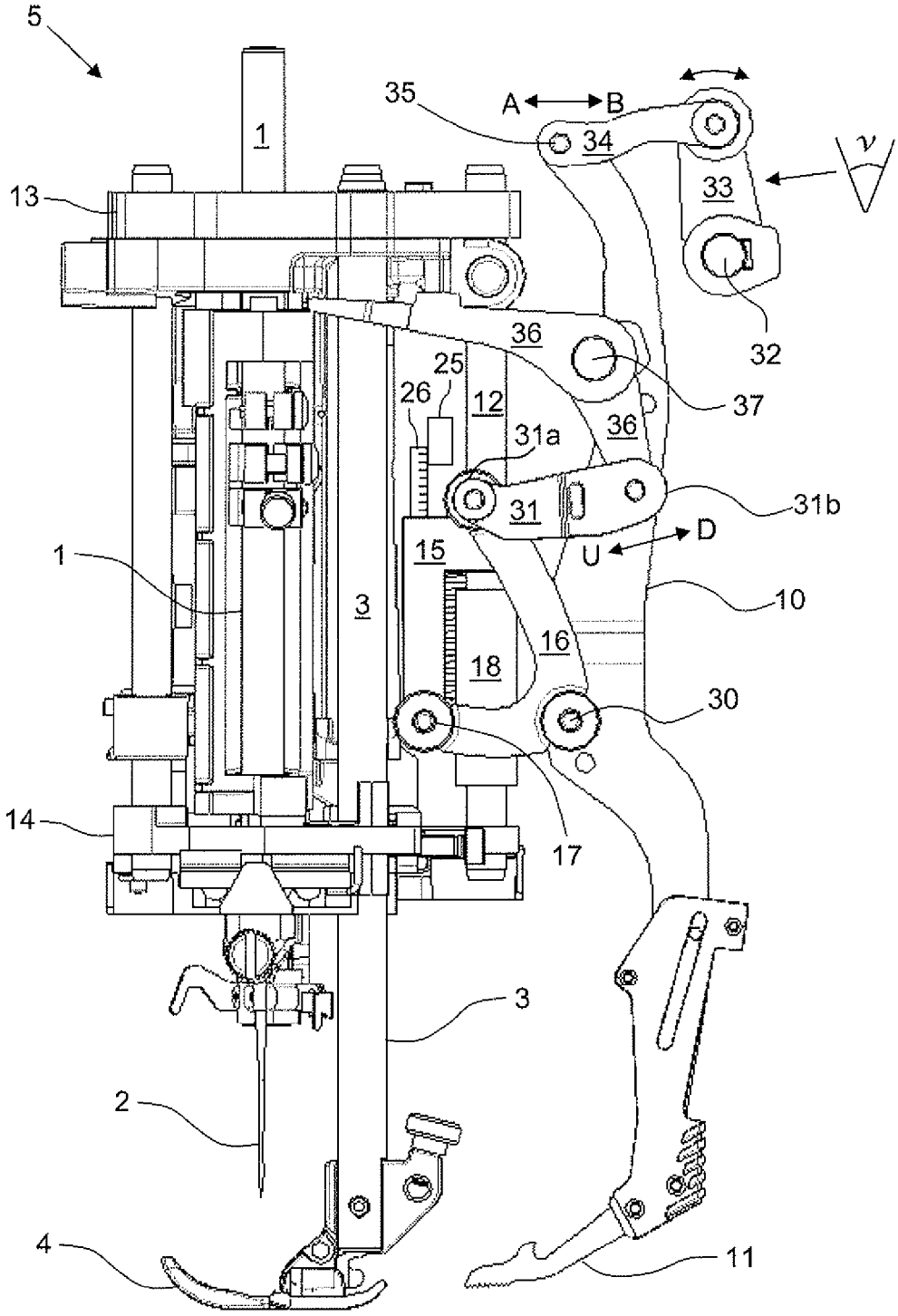
FIG. 1 schematically shows a side view of a sewing head of a sewing machine provided with an arrangement for setting a predetermined top feeder pressure against a piece of cloth to be sewn. This view shows the links attached to the top feeder arm.
Figure 2:
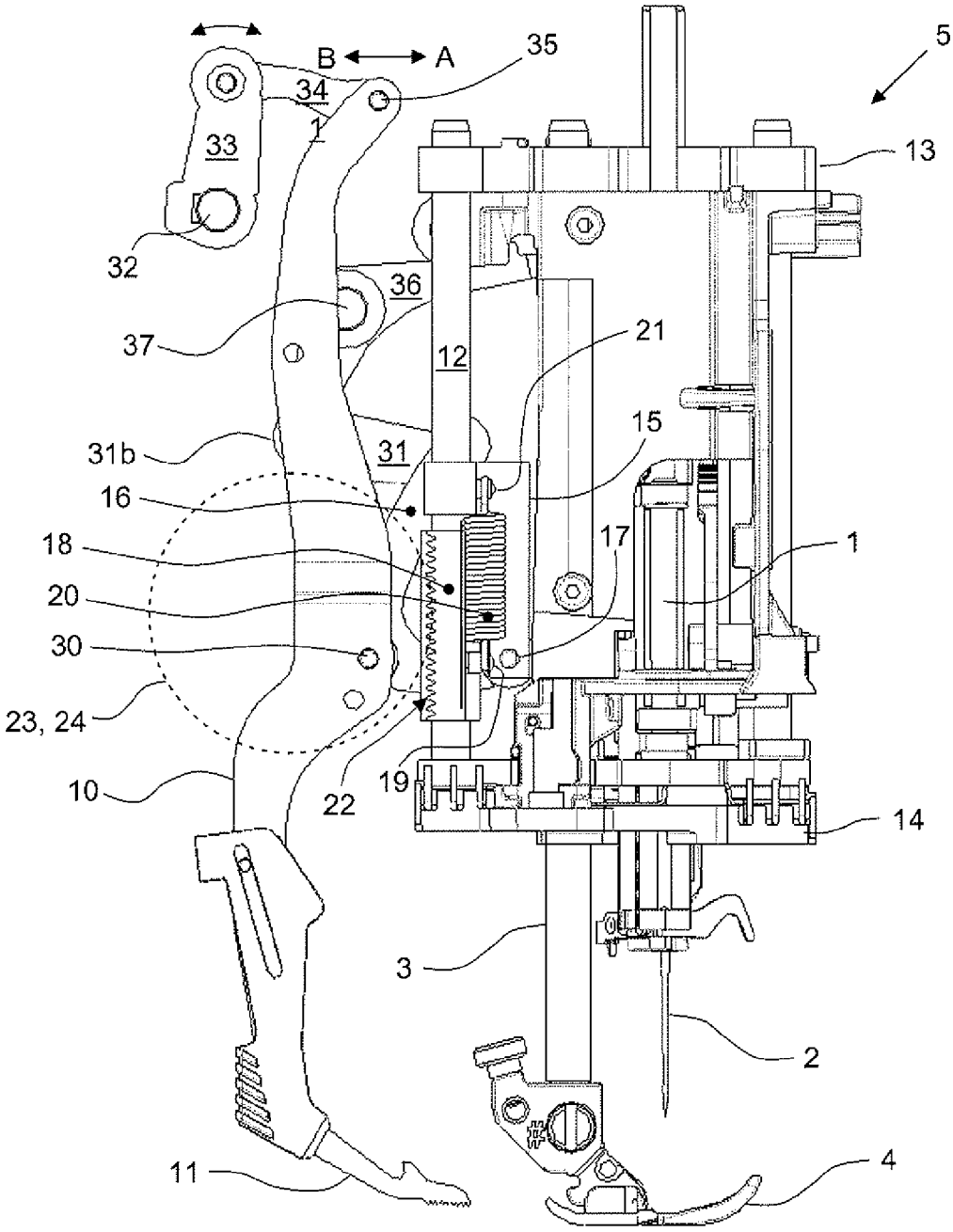
FIG. 2 schematically shows a side view of the sewing head of FIG. 1 but seen from the opposite direction.

Below, the invention will be explained in greater detail by description of at least one enabling embodiment with reference to the accompanying drawings.

The arrangement shown in the drawings represents a portion of a domestic sewing machine, herein called a sewing head. Said arrangement comprises a vertically movable needle bar 1 provided with a needle 2 and a likewise vertically movable presser bar 3 provided with a presser foot 4.

Figure 4:
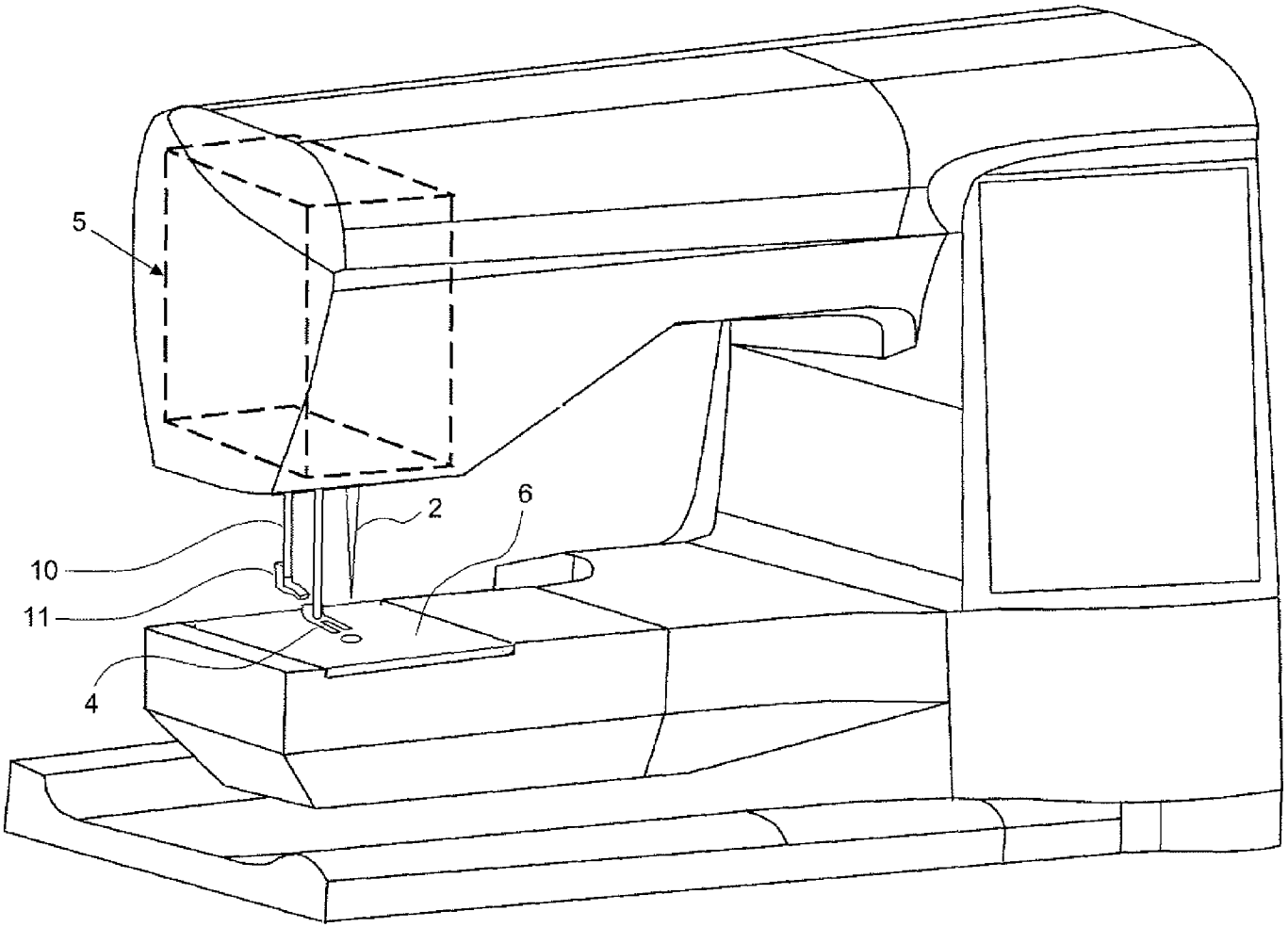
FIG. 4 illustrates the location of the sewing machine head inside the sewing arm of a schematically outlined domestic sewing machine.

According to one embodiment of the present invention, presented in the following, the arrangement is further provided with a top feeder arm 10 having a top feeder 11 at its lower end. The purpose with the top feeder 11 is to feed a cloth inserted in the sewing machine by acting from the upper side of the cloth. Said feed is performed in a cyclic movement mechanically controlled by the drive shafts of the sewing machine according to prior art. The feed using said top feeder is thus synchronized with the feed of the cloth, during sewing, from the lower side of the cloth accomplished by the feeder arranged in a stitch plate 6 (FIG. 4) under the cloth conventionally occurring on domestic sewing machines.

The arrangement according to the invention is further provided with a substantially vertical top feeder bar 12 fixedly arranged to a framing of the sewing head, in this embodiment extending between a top plate 13 and a bottom plate 14 of the framing of the sewing head. A dog member 15 is slidably arranged around the top feeder bar 12 by being journalled to the top feeder bar, in such a way that the dog member 15 can run longitudinally along the top feeder bar 12. A boomerang formed lever 16 pivotally attached, at a centre axis 30 of rotation of the boomerang lever, to the top feeder arm 10 is hinged at a lower end of the lever 16 to the dog member 15 at a hinge axle 17. Said pivotally attachment at said axis 30 of rotation is arranged approximately at the middle of the bend of the boomerang formed lever 16, where said lever 16 is pivotally attached to the top feeder arm 10 at said centre axis 30 of rotation. The upper end of the boomerang formed lever 16 is held substantially at the same level in relation to the top feeder arm 10 by a height regulation link 31, which will be more in detail described below.

Further, according to the present invention, a sleeve member 18 is slidably arranged to the top feeder bar 12, whereby the sleeve member 18 is allowed to run longitudinally along the top feeder bar 12. In the present embodiment, the sleeve member 18 is arranged below the dog member 15 in relation to the top feeder bar 12. The sleeve member 18 is provided with a first attachment point, in this embodiment a protrusion 19. A resilient member 20, such as a spring, is at its lower end attached to said protrusion 19, and at its upper end attached to a second attachment point, in this embodiment a corresponding protrusion 21 of the dog member 15.

If a pressure is exerted on the dog member 15, e.g. in the downward direction, the pressure from the top feeder 11 against the cloth during sewing will be increased and correspondingly, the pressure from the top feeder 11 against the cloth will be decreased if the dog member 15 is slid upwards along the top feeder bar 12. Correspondingly, if anything affects the top feeder 11 such that suddenly the top feeder arm 10 is raised or lowered, the dog member 15 will be raised or lowered as a result. The movement of the dog feeder 15 influences the resilient member 20 to become more or less stretched in relation to the sleeve member 18. This movement of the dog member 15 in relation to sleeve member 18 is possible to sense by utilizing a sensor as will be described below.

Moreover, if the sleeve member 18 is forced to move downwards along the top feeder bar 12 the resilient member 20 will exert a pulling force on the dog member 15, whereby, in turn, the top feeder arm 10 and the thereto attached top feeder 11 will exert an increased pressure on the cloth during the top feeding of the cloth. In a corresponding way, if the sleeve member 18 is forced to move upwards, this will lead to a lower pressure being exerted on the cloth during top feeding of the cloth.

The sleeve member 18 is provided with teeth 22 along at least a portion of its length. A toothed wheel 23 (only shown symbolically by a dotted circle) acting as a drive mechanism for displacing said sleeve member 18 can be arranged to engage the teeth 20 of the sleeve member 18. Thus, the pressure of the top feeder 11 against the cloth can be adjusted manually by an operator, who can rotate said toothed wheel in such a way that the sleeve member is adjusted upwards or downwards along the top feeder bar 12.

In a preferred embodiment the manipulation of the sleeve member 18 is performed by means of a stepping motor 24 (only shown in this embodiment as included in the dotted circle symbolizing both the toothed wheel 23 and the stepping motor) provided with a toothed wheel engaging the teeth 22 of the sleeve member 18. The movements of the sleeve member 18 upwards or downwards along the top feeder bar 12 for regulating the pressure from the top feeder 11 against the cloth can thus be controlled by means of electrical signals provided to the stepping motor 24. Said electrical signals are preferably distributed by a processor of the sewing machine for controlling said pressure of the top feeder 11 according to predetermined values. The stepping motor 24 can of course be located in other positions than the one suggested in FIG. 1, whereby the movements performed by the stepping motor may be transferred to the toothed wheel 23 by transfer means, such as gear wheels in a known manner.

In still another preferred embodiment, the value of the pressure of the top feeder 11 against the cloth can be made self-regulating. To accomplish this, a sensor 25 for sensing the movements of the dog member 15 along the top feeder bar 12 is attached to the sewing head or fixed in another way to the sewing machine body. The readings of the movement of the dog member 15, vertically, by utilizing said sensor 25 can be performed in many ways, e.g. by attaching a code disc 26 to the dog member 15. Said code disc could be provided by bar codes or holes coded in a way such that the sensor 25 reading said codes can determine height changes of the dog member 15 precisely.

Thus, if a sensor 25 is provided, the pressure of the top feeder 11 against the cloth can be kept at a desired predetermined value. If, e.g. the cloth has some irregularities, which the top feeder passes during sewing, such as spots of the cloth where the cloth is thicker, the top feeder 11 could all of a sudden become raised from the cloth. This movement of the dog feeder upwards is immediately detected by the sensor 25, whereupon the processor will send adjusting information signals to the stepping motor 24, to decrease the pressure, whereby this regulation of a predetermined value of the top feeder 11 pressure against the cloth can be substantially maintained.

Above, it is mentioned that the sleeve member 18 and the dog member 15 have protrusions for attaching the resilient member. The specified attaching member, such as the protrusions, can of course be substituted with any proper means for attaching the resilient member 20 to the dog member 15 and the sleeve member 18, respectively. Thus hooks, holes, screws, loops or the like could conveniently be used for attaching the resilient member 20.

Further, as an example of a resilient member 20, a spring is suggested. Also in this case any convenient member presenting the same function as the spring suggested can be used, such as a piece of rubber, a piece of resilient plastics or the like. Common to the resilient members 20 according to the disclosed embodiment is that they are contracting. As an alternative, expanding resilient members may, of course, be used if necessary redesign of components adherent to the resilient member is carried out. Such redesign is common art and familiar to the man skilled in the art.

Still another example of the advantage by using the described invention is described herein. During sewing, using top feeding according to prior art, the cloth is, as a complement to the normal feeding performed from the bottom side of the cloth, fed from the upper side of the cloth by the top feeder 11. When the thickness of the cloth varies, for example due to a varying number of cloth layers, the top feeder 11 feeding the cloth from the upper side can enter a state where it is out of timing in relation to the bottom feeder in the stitchplate. This results in a different feeding of the cloth layer or cloth layers on the upper side with respect to feeding at the under side of the cloth to be sewn, which in turn ends up with distorted and unattractive seams on the layers of cloth. The reason for this is that the pressure from the top feeder 11 against the cloth varies in dependence of the thickness of cloth layers and the quality of the cloths. The arrangement according to the invention offers, on the other hand, the possibility to avoid this drawback in that the height of the top feeder 11 above the stitch plate 6 is sensed by the differential gauge (the sensor 25 and code disc 26 in cooperation). By keeping the sensed value of said height around a certain default value, it is possible, if preferred, to provide a constant top feeder pressure irrespective of variations of cloth thickness. This is obtained in that the position of the sleeve member 18 is adjusted by means of the stepping motor a distance corresponding to a displacement of the top feeder 11 as a result of the cloth thickness influences on the top feeder height, whereby the tension of the resilient member 20 is maintained unchanged. It is further possible to obtain any desired relation between the top feeder 11 pressure and the cloth thickness that might be appropriate for the actual sewing operation. In such case, the preferred relation between the top feeder 1 pressure and the cloth thickness is set by means of the processor of the sewing machine.

The top feeder 11 can be raised to a relieved level, where it is at first raised just enough to relieve the top feeder from the cloth, whereby the cloth is not held in a fixed position but can be moved in relation to the cloth feeders. To provide adjustment to this relieved level, the stepping motor is activated for lifting until the movement sensed by the differential gauge 25, 26 has ceased, and then an additional predetermined number of steps, to release the cloth from the top feeder 11.

The relieved level can be used to release the cloth temporarily during a short period when the needle is in a top level, in which a cloth feed is normally carried out by means of the feeding members (bottom feed and top feed) of the machine. Due to the fact that the cloth is not fixed in this stage, a manual cloth feed can be performed instead of the automatic cloth feed, which is arranged to be inoperative during the course of said stage. By the end of the mentioned course the top feeder 11 returns to its lowered level and predetermined top feeder pressure, whereby the cloth is held during stitch formation and thread tensioning. As described, manual cloth feed is permitted in any direction during a period of relieved level of the top feeder 11.

Although, the feeding movement of a top feeder and the connected top feeder arm is known technology in prior art sewing machines, some adjustments of the mechanics in relation to prior art has been performed for the movements of the top feeder arm 10 of the present invention in order to adapt the movements of the top feeder arm 10 to the use of the dog member 16 and sleeve member 18 running along the top feeder bar 12. The cyclic movements of the top feeder arm 10 will thus briefly be described here.

The top feeder arm 10 basically performs two separate motions, one first motion forwards and backwards and a second motion from a lowered level to a raised level. During the forwards motion, in a lowered level, the top feeder 11 acts on the cloth and feeds the cloth forwards. In a raised level, during backwards motion, the top feeder 11 is reversed from a foremost position to a rearmost position during which motion the cloth is not affected by the top feeder 11.

The first motion of the top feeder arm 10 is arranged by use of a rocking axle 32. Said rocking axle 32 is coupled to and synchronized with the bottom feeder (not shown) of the sewing machine in such a way that a rocker arm 33 is rocking an angle v as indicated in FIG. 1. Said rocking arm 33 actuates a connection link 34 pivotally connected to the upper end of top feeder arm 10 at point 35 such that the upper end of top feeder arm 10 moves between positions A and B indicated by an arrow in the figure at point 35. The top feeder arm 10 is journalled in centre axis 30 of rotation in a position somewhere along a centre part of the top feeder arm 10. Said centre axis 30 of rotation is substantially immovable horizontally. Thus, when connection link 34 at the upper end of top feeder arm 10 moves in direction B, top feeder 11 is forced to move forwards. Correspondingly, when connection link 34 moves in direction A, top feeder 11 is forced to move backwards.

Figure 3:
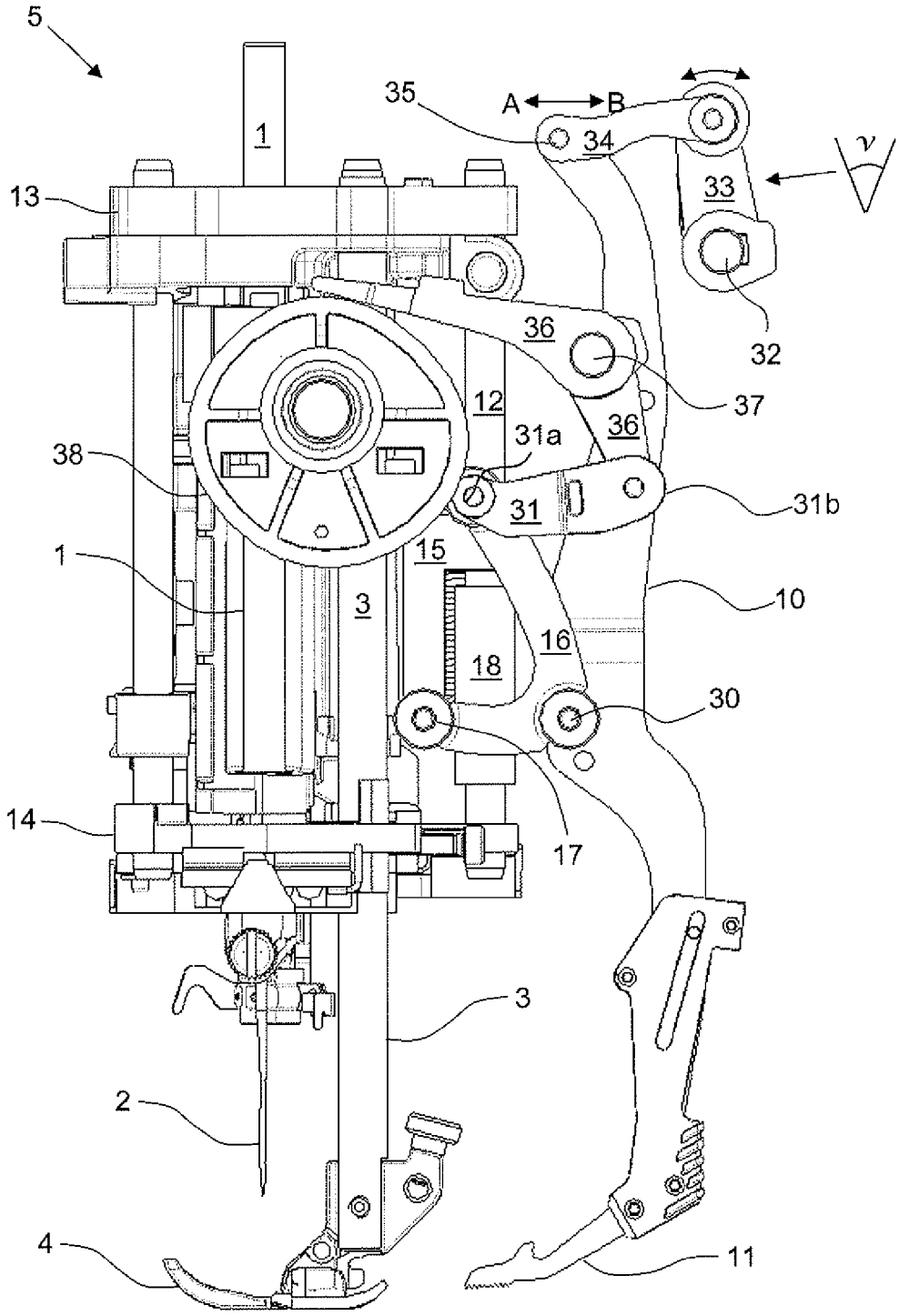
FIG. 3 schematically shows the same side view as FIG. 1 with a cam disc mounted to the sewing head.

The second motion, lowering and raising, of the top feeder arm 10 is performed as follows. An angled arm, herein referred to as a height actuation link 36 is pivotally arranged on a height regulation axle 37, which is being fixed in its position in space in relation to the sewing head. The height actuation link 36 has its apex approximately at said axle 37. A second, lower, end (that is the end of the downwards directed side of angle of the angled arm) of said height actuation link 36 is pivotally arranged around a second point 31*b* at a second end of previously mentioned height regulation link 31. A first end of said height regulation link 31 is pivotally attached at a first point 31*a* to the upper end of the boomerang formed lever 16. A first, substantially horizontally directed, end (that is the end of the horizontally directed side of angle of the angled arm) of said height actuation link 36 abuts a cam disc 38 (FIG. 3). Said cam disc 38 is driven by an axle rotating in step with other members of the sewing machine such as the up and down movements of the needle and the feeding movements of the bottom feeder. The circumferential surface of the cam disc 38 is formed to control, during its rotation, the up and down movement of the top feeder in synchronization with the needle and the feeding of the cloth. Link 36 is pressed against said circumferential surface by means of a spring. When, during rotation of said cam disc 38, the surface of the cam disc guides said first end of height actuation link 36 downwards, height actuation link 36 will rotate about axle 37, such that the second end of height actuation link 36 moves the height regulation link 31 in direction D indicated by the arrow at point 31*b* of FIG. 1. When the surface of the cam disc 38 lowers the first end of height actuation link 36, the height actuation link 36 swivels back, whereby height regulation link 31 moves in direction U as indicated by the same arrow. As may now be understood, when height regulation link 31 moves in direction D, a tractive force is acting on upper end of boomerang formed lever 16. As the lower end at hinge axle 17 of boomerang formed lever 16 is substantially fixed in position in space, boomerang formed lever 16 will rotate clockwise and thereby lowering top feeder arm 10 to its feeding level as the clockwise rotation of boomerang formed lever 16 forces centre axis 30 of rotation downwards thereby lowering top feeder arm 10. Correspondingly, when height regulation link 31 moves in direction U a pressure force directed to the left in FIG. 3 is acting on upper end of boomerang formed lever 16, which will rotate anti clockwise and thereby raising top feeder arm 10 to its backwards moving level as the anti clockwise rotation of boomerang formed lever 16 forces centre axis 30 of rotation upwards thereby raising top feeder arm 10. The distance d between the raised position and the lowered position of the top feeder arm 10 can be chosen conveniently by a proper dimensioning of link lengths and pivoting axle positions. Further, the above disclosed embodiment is an enabling disclosure. Numerous different mechanical solutions to the feeding of the top feeder according to predetermined motions are of course possible.

The invention claimed is:

1. A top feeder arrangement for a sewing machine provided with a processor for controlling stitches sewn on a cloth, said sewing machine having a sewing machine head comprising:

a needle mechanism having a needle bar provided with a needle, a presser bar provided with a presser foot, and a top feeder arm provided at its lower end with a top feeder acting from an upper surface of a cloth for feeding the cloth in the sewing direction, characterized in that the sewing machine is provided with a mechanism providing a controllable pressure of the top feeder against the cloth, the mechanism comprising:

a substantially vertically mounted top feeder bar, a dog member slidably arranged to said top feeder bar and said top feeder arm being pivotally attached to the dog member, a sleeve member slidably arranged along said top feeder bar, and a resilient member attached between said sleeve member and said dog member, wherein said top feeder pressure is controlled by means of a displacement of said sleeve member.

2. The top feeder arrangement according to claim 1, wherein said top feeder arm is mechanically suspended to the sewing machine head and arranged to move the top feeder in a cyclic movement along a closed loop including said top feeder being lowered, forwarded, raised and reversed in this order on feeding the cloth forwards or in a corresponding adversed order when the cloth is fed backwards.

3. The top feeder arrangement according to claim 2, wherein a cam disc rotating in step with the cyclic movement of the needle is arranged to control the movement of the top feeder arm and thereby forcing the top feeder to perform said cyclic movement along said closed loop.

4. The top feeder arrangement according to claim 1, wherein said sleeve member is provided with engagement means, such as teeth or a working face.

5. The top feeder arrangement according to claim 4, wherein a drive mechanism, such as a drive wheel or a drive rod, engages said engagement means of the sleeve member; said drive mechanism operable manually or by means of a stepping motor.

6. The top feeder arrangement according to claim 5, wherein the processor of the sewing machine controls the stepping motor when said drive mechanism is operated by means of the stepping motor.

7. The top feeder arrangement according to claim 5, wherein a sensor is arranged to measure displacements of the dog member along the top feeder bar.

8. A method for top feeding a cloth by means of a top feeder in a sewing machine, the method characterized in that it includes the steps of:

controlling a pressure of the top feeder against the cloth by means of a mechanism, manually or by means of a stepping motor set to maintain a predetermined pressure, sensing displacements of the top feeder in a substantially vertical direction during top feeding of the cloth, forwarding information of said displacements to a processor, regulating said predetermined pressure by said processor controlling said stepping motor, which in turn sets said mechanism to maintain said pressure, wherein said regulation of said predetermined pressure further includes the steps of:

engaging a sleeve member by said stepping motor to move said sleeve member along a top feeder bar, wherein said sleeve member acts on a resilient member that further acts on a dog member that is movable along said top feeder bar, and actively adjusting, by said dog member, the height of a top feeder arm housing said top feeder at its lower end, according to the settings of the stepping motor.

9. A sewing machine provided with the top feeder arrangement according to claim 1.

10. The sewing machine according to claim 9, wherein the sewing machine includes a processor provided with a computer program coded to perform instructions to a stepping motor for controlling said pressure of the top feeder against the cloth.

* * * * *